United States Patent [19]

Chaiko

[11] Patent Number: 4,676,182

[45] Date of Patent: Jun. 30, 1987

[54] SUSPENSION MEANS FOR A MOORING LINE

[76] Inventor: Walter M. Chaiko, 6200 Ibis Rd., Fairfield Harbour, New Bern, N.C. 28560

[21] Appl. No.: 591,936

[22] Filed: Mar. 21, 1984

[51] Int. Cl.[4] ..... B63B 21/00

[52] U.S. Cl. ..... 114/230; 248/290

[58] Field of Search ..... 114/230, 250, 249, 183 R, 114/221 R; 248/290, 289.1

[56] References Cited

U.S. PATENT DOCUMENTS

| | | | |
|---|---|---|---|
| 3,120,831 | 2/1964 | Fulton | 114/230 |
| 3,183,877 | 5/1965 | Benzel | 114/230 |
| 3,187,707 | 6/1965 | Carbolie | 114/230 |
| 3,195,498 | 7/1965 | Johns | 114/230 |
| 3,280,784 | 10/1966 | Stainbrook | 114/230 |
| 3,307,514 | 3/1967 | Young | 114/230 |
| 3,373,714 | 3/1968 | Hart | 114/230 |
| 4,280,440 | 7/1981 | Barton | 114/230 |
| 4,462,329 | 7/1984 | Brushaber | 114/230 |
| 4,479,454 | 10/1984 | Schepel | 114/230 |
| 4,557,214 | 12/1985 | Molitor | 114/221 R |

*Primary Examiner*—Joseph F. Peters, Jr.
*Assistant Examiner*—C. T. Bartz
*Attorney, Agent, or Firm*—Bernard J. Murphy

[57] ABSTRACT

According to the embodiment depicted, the Suspension Means comprises a flexible limb pivotably coupled, at one end, to a mounting bracket, and having a mooring line hook attached to the opposite end thereof. In addition, the hook has a weighting container pendantly attached thereto, for suspension therefrom, the container being buoyant. The hook is attached to the limb by a length of line, and the container is coupled to the hook by a further length of line. Accordingly, the buoyant container is able to float while causing the limb to bend and dispose the mooring line hook for ready access thereto by a person aboard a water-going vessel. The accessible hook suspends the loop end of a mooring line, and the limb, flexed by the weighting container, holds the hook outward for grasping of the loop end and removal of the mooring line therefrom for tethering of the vessel. The mounting bracket is adjustable in order to dispose the limb at selective angles relative thereto, as warranted by the elevation of the pier or dock to which the bracket is fixed.

9 Claims, 5 Drawing Figures

FIG. 3
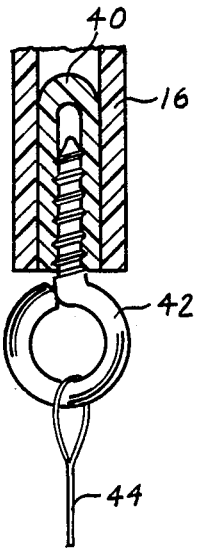
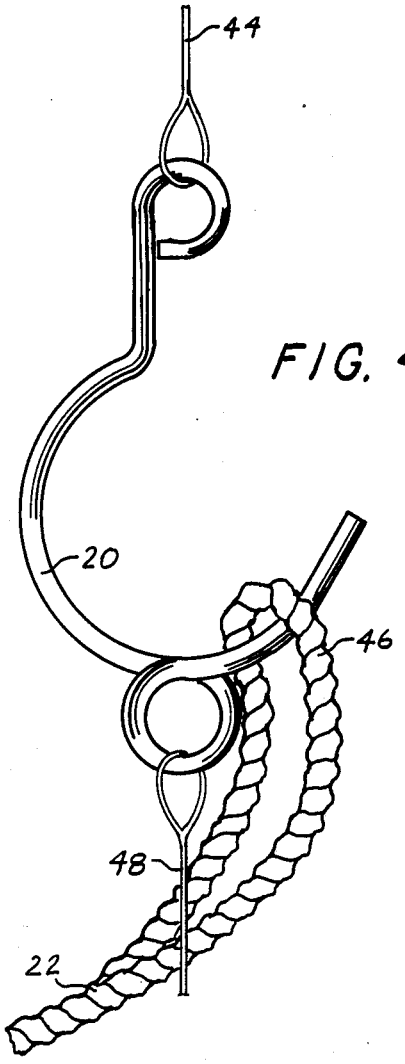
FIG. 4
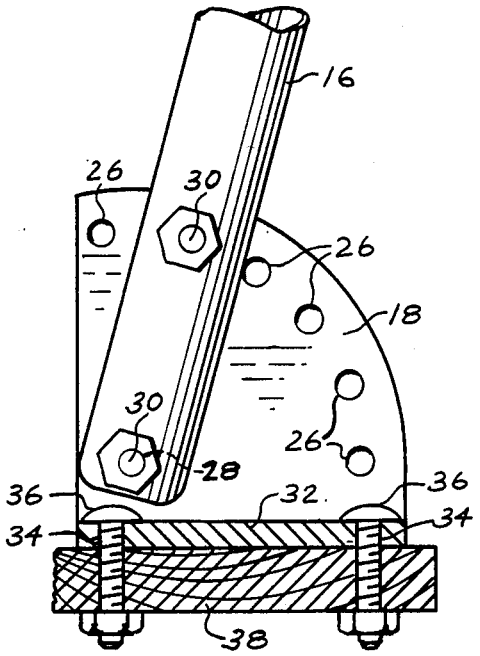
FIG. 2
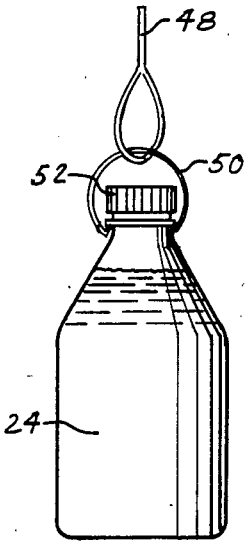
FIG. 5

SUSPENSION MEANS FOR A MOORING LINE

This invention pertains to mooring devices for lashing sea-going vessels to docks or piers or the like, and in particular to means for disposing a mooring line for a boat or a ship in an attitude of accessability, relative to a dock or pier, for a person on board such boat or ship, to facilitate mooring of the vessel.

Ships and boats, particularly sailboats, have some difficulty in getting moored to a dock or pier. Sailboats can easy and quickly be blown out of mooring position. Too, for sailboats and other types of vessels, the access to mooring lines commonly requires some agility and quick action. Mooring lines are usually left lying on the dock or pier. Hence, it is necessary for someone to alight from the vessel, get onto the dock or pier, and then back to the vessel to tie the lines of the cleats of the vessel. If someone happens to be nearby, and can toss the ends of the mooring lines to a person on board the vessel, lashing of the latter need not be attended with any difficulty. However, it is not prudent to rely on there being someone available to assist as aforesaid. Particularly is it important for a lone sailor, aboard a light-draft sailboat, for instance, to be able to tend to the mooring of the vessel by himself or herself. Further, stepping from a buoyant vessel to a stationary landing, and back again, is fraught with some risk of injury.

It is an object of this invention to set forth a novel suspension means for a mooring line which will obviate the aforecited difficulties and risk of injury, and greatly facilitate the mooring of a water vessel.

It is particularly an object of this invention to set forth suspension means for a mooring line comprising an elongate limb; said limb being formed of flexible material; and means defining a support for said limb; wherein said support has (a) means for removably securing one end of said limb thereto, and (b) means for fastening thereof to a bearing surface; and further including means coupled to the other end of said limb for suspending therefrom (a) means for releasably holding a mooring line, and (b) means for weighting said other end of said limb.

Further objects of this invention, as well as the novel features thereof, will become more apparent by reference to the following description taken in conjunction with the accompanying figures, in which:

FIG. 2 is a view, greatly enlarged over the scale of FIG. 1, showing the support (partly cross-sectioned) bolted to a plank of the dock, and the lowermost end of the flexible limb fastened to the support;

FIG. 3 is a cross-sectional view taken through the end of the limb, along the axis thereof, illustrative of fastening of the hook line thereto;

FIG. 4 is an elevational view of the mooring line hook, showing a loop end of a mooring line held thereby and ends of the hook and weight lines; and FIG. 5 is an elevational view of the container-weight pendantly attached to the weight line.

FIGS. 3–5 are in substantially the same scale as FIG. 2.

Figure 1:
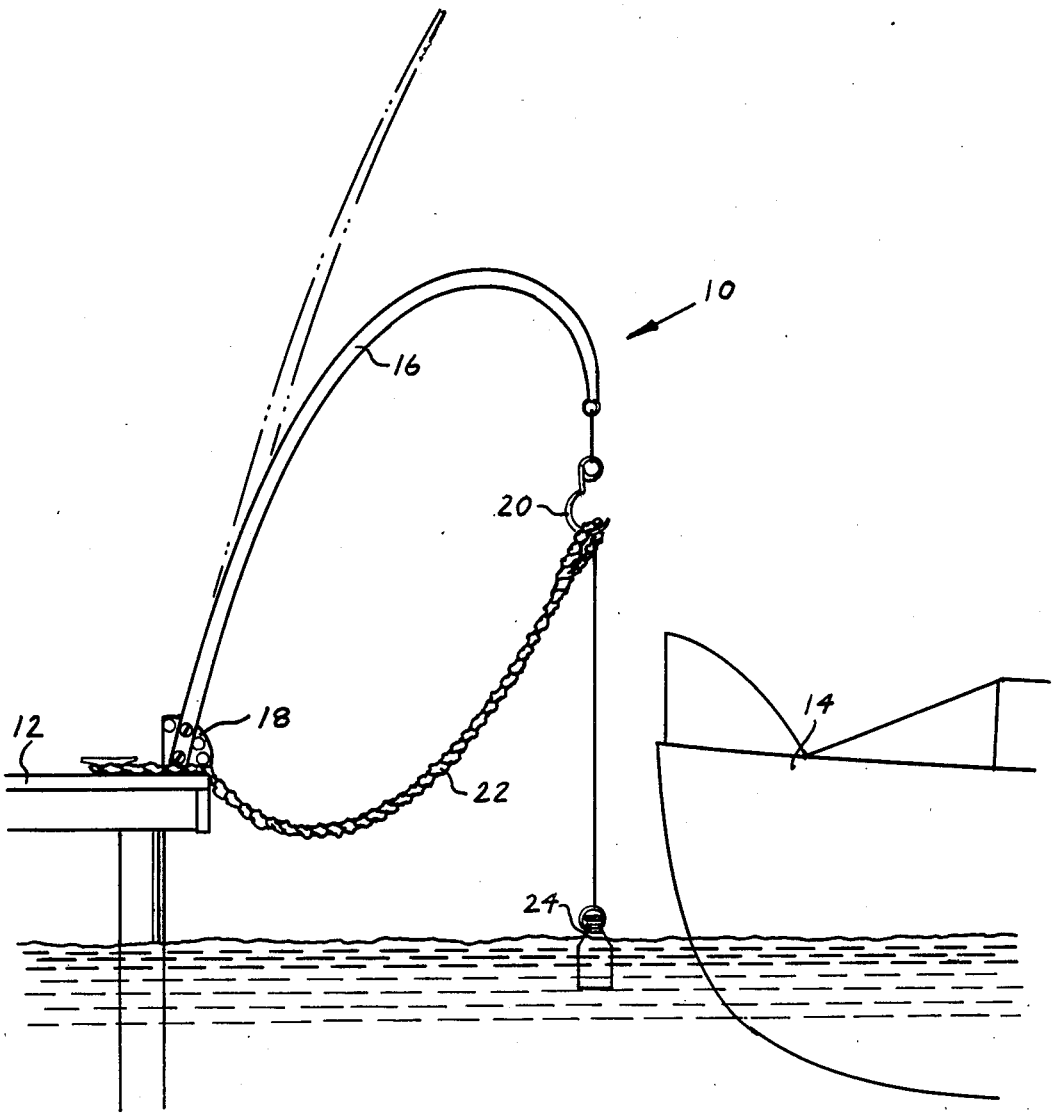
FIG. 1 is a pictorial illustration of the novel mooring line suspension means fixed to a dock and in association with the bow of a boat.

As shown in the figures, the novel suspension means for a mooring line 10, is fixed to a dock 12 to facilitate the mooring of a boat 14. The invention comprises a flexible limb 16 secured at one end to a support 18, the latter being bolted to the dock 12, and having a hook 20 pendant from the opposite end. The hook 20 receives the loop end of a mooring line 22, and a weight 24 causes the limb 16 to bend and dispose the mooring line end within accessability to a person on board the boat 14.

Support 18 has a web in which are formed a plurality of bolt holes 26, the same being arrayed along a given radius from another, pivot bolt hole 28 also formed in the web. The lowermost end of the limb 16 has corresponding bolt holes formed therethrough, i.e., a pair thereof spaced apart a distance which corresponds to the length of the aforesaid radius. Bolts 30, fixed in the latter pair of bolt holes in the end of the limb 16, and through one of the holes 26 and the pivot bolt hole 28, dispose the limb end at a given angle relative to the base 32 of the support 18. The base 32 also has bolt holes 34 formed therethrough to receive bolts 36 with which to fasten the support 18 to a plank 38 in the dock 12.

It will be evident that, by simply removing the uppermost bolt 30 from the bolt hole 26 through which it is passed, and fastening it through another of the bolt holes 26, the lowermost end of the limb 16 can be set at another angle relative to the base 32 and the dock 38.

Limb 16 is flexible, and is also hollow. At the free end thereof, in the hollow thereof, there is fixed an insert 40. The latter threadedly receives the threaded end of an eye-bolt 42. In turn, eye-bolt 42 has a loop end of a filamentary line 44 secured thereto. Line 44 has the other end thereof, which also has a loop therein, secured in a loop termination of a mooring line hook 20. The loop end 46 of the mooring line 22 is received in and held by the hook 20. An intermediate portion of the hook 20 is turned back upon itself to define an eyelet thereat. A loop end of a weight line 48 is captive in the eyelet, and the opposite end of the weight line, also having a loop therein, encircles a bail 50 secured to the weight 24.

Weight 24, in this embodiment of the invention, comprises a transparent container, having a screw-cap closure 52, into which a desired quantity of weighting material or substance may be placed. In the exemplary embodiment shown, the weighting substance is liquid (i.e., water). The container-weight 24 confines an air space therein, above the weighting liquid, to insure that it will be buoyant in water and, clearly, more or less weighting substance and/or air space may be provided to vary the weighting and buoyancy thereof.

As illustrated in FIG. 1, the weight 24 causes the limb 16 to bend, describing a sustantially U-shaped conformation, to dispose the hook 20 at a level and reach whereat it can present the loop end 46 of the mooring line within the grasp of a person aboard the boat 14. Differing circumstances, of course, will dictate given adjustments of the suspension means 10. Hence, the height of the deck of the boat 14, vis-a-vis the level of the dock 12, will have a bearing in determining what ought to be the length of the weight line 48, perhaps the length of the hook line 44, and the angulation of the limb 16 relative to the support 18. Also, the weight of the mooring line (or mooring lines) 22 will warrant more or less weighting substance in the weight 24. These are considerations which can be settled empirically by the user of the invention who can make the necessary adjustments to suit his or her circumstances.

Considering a boat already moored at a dock which is equipped with one of suspension means 10, the use of the latter is as follows. The mooring line (or lines) 22 will be secured to a cleat (or cleats) on the boat, and the weight 24 will be reposing either on board the boat or on the dock 12. One sets the weight 24 in the water, and this causes the limb 16 to bend. The limb 16 will flex from the substantially vertical disposition shown in phantom in FIG. 1, to the substantially U-shaped disposition shown in full line. The loop end 46 of the mooring line is placed over the hook 20, upon such line 22 having been removed from its boat cleat. The boat is now free and untethered. Upon returning to the dock 12 for mooring of the boat again, one on board has only to reach out from the deck of the boat to grasp the advantageously disposed loop end 46 of the mooring line 22 and secure it again to a boat cleat. Then the weight 24 is lifted from the water and set upon the dock 12 or the deck of the boat. This allows the limb to return to its upright, near vertical disposition.

While I have described my invention in connection with a specific embodiment thereof, it is to be clearly understood that this is done only by way of example and not as a limitation to the scope of my invention as set forth in the objects thereof and in the appended claims.

I claim:

1. Suspension means for a mooring line, comprising:
a single elongate limb;
said limb being formed of flexible material; and
means defining a support for said limb; wherein
said support has (a) means for removably securing one end of said limb thereto, and (b) means for fastening thereof to a bearing surface; and further including
means coupled to the other end of said limb for suspending therefrom (a) means for releasably holding a mooring line, and (b) means for weighting said other end of said limb; wherein
said weighting means is of buoyant construction for cooperation with said limb of flexible material for maintaining said mooring line holding means at a constant height from any given level of any body of water, in which said buoyant weighting means is buoyantly floated, in spite of tidal changes in such body of water; and
said securing means comprises means for maintaining said limb in a substantially vertical disposition.

2. Suspension means, according to claim 1, wherein:
said weighting means comprises a length of filamentary material, and a weight;
one end of said filamentary material is attached to said other end of said limb, and the other end of said filamentary material is attached to said weight; and
said weight comprises a container.

3. Suspension means, according to claim 2, wherein:
said container has a removable closure.

4. Suspension means, according to claim 1, wherein:
said limb comprises means responsive to a weighting of an end thereof for causing said latter end, and an intermediate portion of said limb, to define a substantially U-shaped conformation.

5. Suspension means for a mooring line, comprising:
a single elongate limb;
said limb being formed of flexible material; and
means defining a support for said limb; wherein
said support has (a) means for removably securing one end of said limb thereto, and (b) means for fastening thereof to a bearing surface; and further including
means coupled to the other end of said limb for suspending therefrom (a) means for releasably holding a mooring line, and (b) means for weighting said other end of said limb; wherein
said weighting means is of buoyant construction for cooperation with said limb of flexible material for maintaining said mooring line holding means at a constant height from any given level of any body of water, in which said buoyant weighting means is buoyantly floated, in spite of tidal changes in such body of water;
said weighting means comprises a length of filamentary material, and a weight;
one end of said filamentary material is attached to said other end of said limb, and the other end of said filamentary material is attached to said weight;
said weight comprises a container; and
said container comprises means for charging thereof with a selective amount of weighting material.

6. Suspension means for a mooring line, comprising:
a single elongate limb;
said limb being formed of flexible material; and
means defining a support for said limb; wherein
said support has (a) means for removably securing one end of said limb thereto, and (b) means for fastening thereof to a bearing surface; and further including
means coupled to the other end of said limb for suspending therefrom (a) means for releasably holding a mooring line, and (b) means for weighting said other end of said limb; wherein
said weighting means is of buoyant construction;
said weighting means comprises a length of filamentary material, and a weight;
one end of said filamentary material is attached to said other end of said limb, and the other end of said filamentary material is attached to said weight;
said weight comprises a container;
said container has a bail; and
said other end of said filamentary material is removably coupled to said bail.

7. Suspension means for a mooring line, comprising:
a single elongate limb;
said limb being formed of flexible material; and
means defining a support for said limb; wherein
said support has (a) means for removably securing one end of said limb thereto, and (b) means for fastening thereof to a bearing surface; and further including
means coupled to the other end of said limb for suspending therefrom (a) means for releasably holding a mooring line, and (b) means for weighting said other end of said limb; wherein
said weighting means is of buoyant construction;
said support comprises a base, and web extending in a normal attitude from said base;
said web has a first bolt hole formed therein which pivotably receives a pivot bolt, and a plurality of other bolt holes formed therein on a common radius from said first bolt hole, said radius comprising a given dimension; and
said one end of said limb has a pair of bolt holes formed therethrough and spaced apart a dimension corresponding to said given dimension; whereby
a pair of bolts secured through said pair of bolt holes in said end of said limb, and through said first bolt hole and one of said other bolt holes in said web, supports said limb at a given angle relative to said base.

8. Suspension means for a mooring line, comprising:

a single elongate limb;

said limb being formed of a flexible material; and means defining a support for said limb; wherein said support has (a) means for removably securing one end of said limb thereto, and (b) means for fastening thereof to a bearing surface; and further including means coupled to the other end of said limb for suspending therefrom (a) means for releasably holding a mooring line, and (b) means for weighting said other end of said limb; wherein said weighting means is of buoyant construction for cooperation with said limb of flexible material for maintaining said mooring line holding means at a constant height from any given level of any body of water, in which said buoyant weighting means is buoyantly floated, in spite of tidal changes in such body of water; and said holding and weighting means comprise (a) a fastener coupled to said other end of said limb, (b) a weight, (c) a mooring line hook, (d) first filamentary material coupling said weight to said hook, and (e) second filamentary material coupling said hook to said fastener.

9. Suspension means for a mooring line, comprising:

a single elongate limb;

said limb being formed of flexible material; and means defining a support for said limb; wherein said support has (a) means for removably securing one end of said limb thereto, and (b) means for fastening thereof to a bearing surface; and further including means coupled to the other end of said limb for suspending therefrom (a) means for releasably holding a mooring line, and (b) means for weighting said other end of said limb; wherein said weighting means is of buoyant construction for cooperation with said limb of flexible material for maintaining said mooring line holding means at a constant height from any given level of any body of water, in which said buoyant weighting means is buoyantly floated, in spite of tidal changes in such body of water; and said securing means comprises means for selectively fixing one end of said limb, removably, in a plurality of angular dispositions from vertical.

* * * * *